US006254367B1

(12) United States Patent
Seiling

(10) Patent No.: US 6,254,367 B1
(45) Date of Patent: Jul. 3, 2001

(54) HIGH VISCOSITY PRODUCT PUMPING METHOD AND APPARATUS

(76) Inventor: Samuel Orrin Seiling, 2307 Viking La., Richmond, VA (US) 23229

( * ) Notice: Subject to any disclaimer, the term of this patent is extended or adjusted under 35 U.S.C. 154(b) by 0 days.

(21) Appl. No.: 09/412,495

(22) Filed: Oct. 5, 1999

Related U.S. Application Data

(60) Provisional application No. 60/106,575, filed on Nov. 2, 1998.

(51) Int. Cl.[7] ..... F01C 1/18

(52) U.S. Cl. ..... 418/206; 418/206.1; 418/1; 418/15; 418/180

(58) Field of Search ..... 418/206.1, 1, 180, 418/15, 206

(56) References Cited

U.S. PATENT DOCUMENTS 5,145,349 * 9/1992 McBurnett ..... 418/206.5

FOREIGN PATENT DOCUMENTS

1273994 * 7/1968 (DE) ..... 418/206
2737761 * 3/1979 (DE) ..... 418/206
2737833 * 3/1979 (DE) ..... 418/206
496360 * 11/1919 (FR) ..... 418/206

* cited by examiner

*Primary Examiner*—Thomas Denion
*Assistant Examiner*—Theresa Trieu

(57) ABSTRACT

The required larger than normal pressure drop between the infeed and pump inlets of a positive displacement gear or lobe type pump pumping a high viscosity fluid such as pastry dough is obtained by the introduction of a vacuum inside the pump at or near the rotary nip points of the gear or lobe type pump to provide a means for the removal of any gas present in the vicinity of the nip point.

2 Claims, 4 Drawing Sheets

HIGH VISCOSITY PRODUCT PUMPING METHOD AND APPARATUS

The benefit under 35 USC 119 of United States provisional application 60/106,575 filed Nov. 2, 1998 is hereby claimed.

FIELD OF THE INVENTION

The present invention relates to an improved method and equipment for pumping high viscosity products such as pastry dough and more particularly to such a method and apparatus that utilizes the introduction of a vacuum into the pump to assist in the generation of a higher than normal pressure drop from the infeed or hopper reservoir to the pump inlet.

BACKGROUND OF THE INVENTION

Automated machinery to produce bread and other pastry products conventionally use single or twin auger pumps. Such auger pumps not only move the dough, but also uniformly damage the dough due to shearing action and then homogenize the degraded dough throughout the dough mass their use to produce a high quality product id somewhat less than fully desirable.

In order to solve the problem of dough damage and degradation, attempts have been made to utilize positive displacement gear or lobe type pumps that impart less damage to the dough for pumping such viscous masses. The problem with such positive displacement pumps resides in their inability to maintain a proper prime to the pump because of the high viscosity of the dough. Maintenance of the prime to the pumps for the pumping of such highly viscous materials requires that the lobe or gear pump produce a larger than normal pressure drop from the infeed or hopper reservoir to the pump inlet to assure that adequate viscous fluid is continuously drawn into the pump.

Thus, a positive displacement gear or lobe type pump that does not damage the pastry dough to the extent that an auger type pump does while being capable of maintaining its prime would provide significant advantages in the pastry dough pumping arena.

OBJECT OF THE INVENTION

It is therefore an object of the present invention to provide a positive displacement gear or lobe type pump and method of operating same that, while providing all of the advantages of such a pump, can readily maintain it prime even when pumping very high viscosity fluids such as pastry dough.

SUMMARY OF THE INVENTION

According to the present invention, the required larger than normal pressure drop between the infeed and pump inlets in a positive displacement gear or lobe type pump pumping a high viscosity fluid such as pastry dough is accomplished by the introduction of a vacuum inside the pump at or near the rotary nip points of the gear or lobe type pump to provide a means for the removal of any gas present in the vicinity of the nip point.

DETAILED DESCRIPTION

Figure 1:
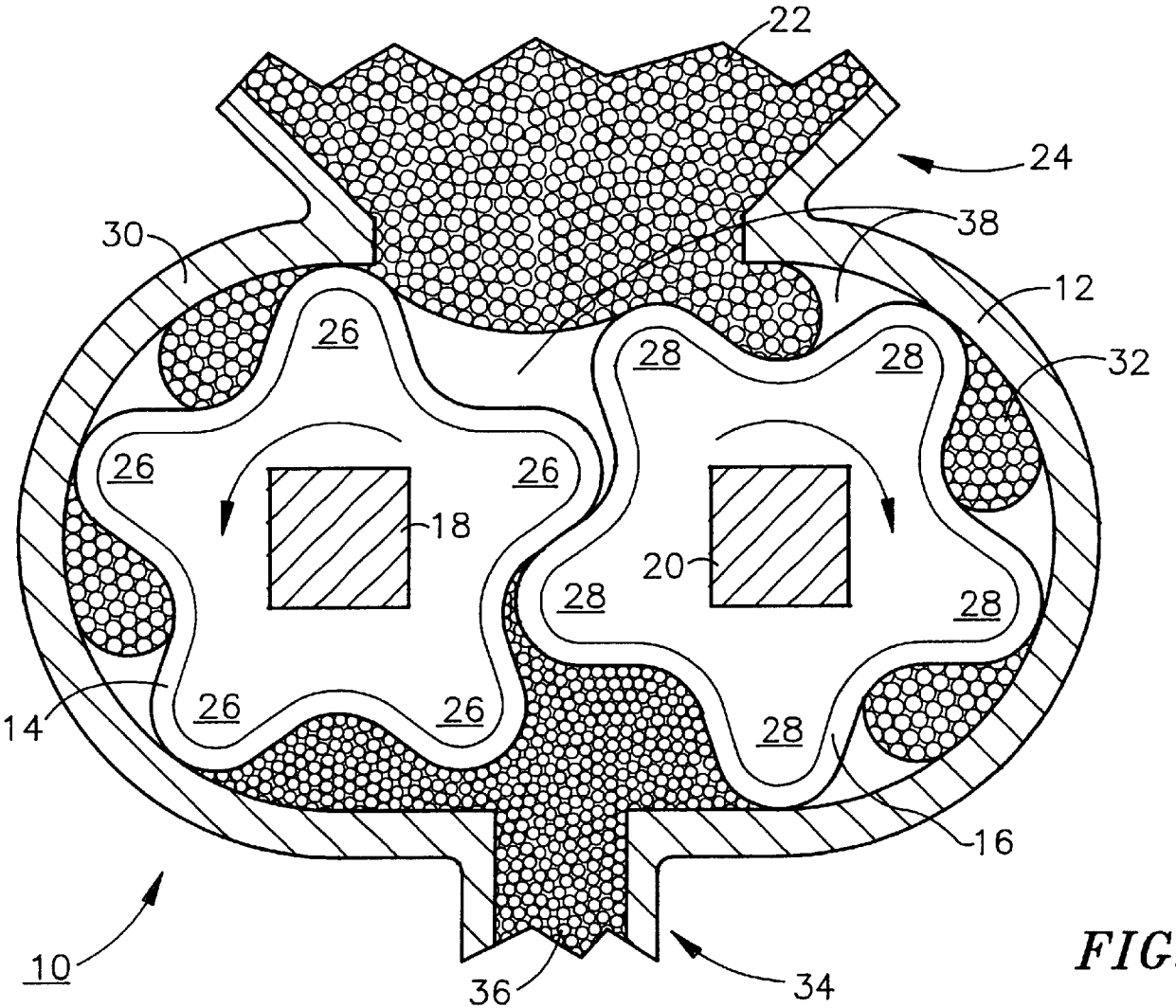
FIG. 1 is a cross-sectional view of a typical rotary pump used to move fluids.

As shown in FIG. 1, a so-called positive displacement gear or lobe pump 10 comprises a housing 12 having two counter rotating lobed gears 14 and 16 mounted on shafts 18 and 20 therein. High viscosity material 22 is supplied to pump 10 via hopper inlet reservoir 24. At this point, material 22 is under low pressure, as represented by the larger balls in FIG. 1, i.e. the pressure provided is solely due to the weight of material 22 in reservoir 24. As gears 14 and 16 counter rotate, lobes 26 and 28 alternately engage portions 30 and 32 of high viscosity material 22 forcing them about the interior of housing 12 and delivering them to discharge port 34 in the form of compressed, high pressure material 36 represented by the smaller balls in FIG. 1. Compression and pressure increase is of course due to the relatively smaller surface area of outlet 34 versus that of inlet reservoir 24.

As described hereinabove, the problem with the operation of such pumps involves their inability to maintain the prime, i.e. the feed of viscous material 22 from reservoir 24 into the area where it may be engaged by lobes 26 and 28, since viscous material 22 does not readily flow due to its high viscosity. Additionally, gas pockets 38 tend to impose a back pressure on incoming material 22 inhibiting its engagement with lobes 26 and 28.

Figure 2:
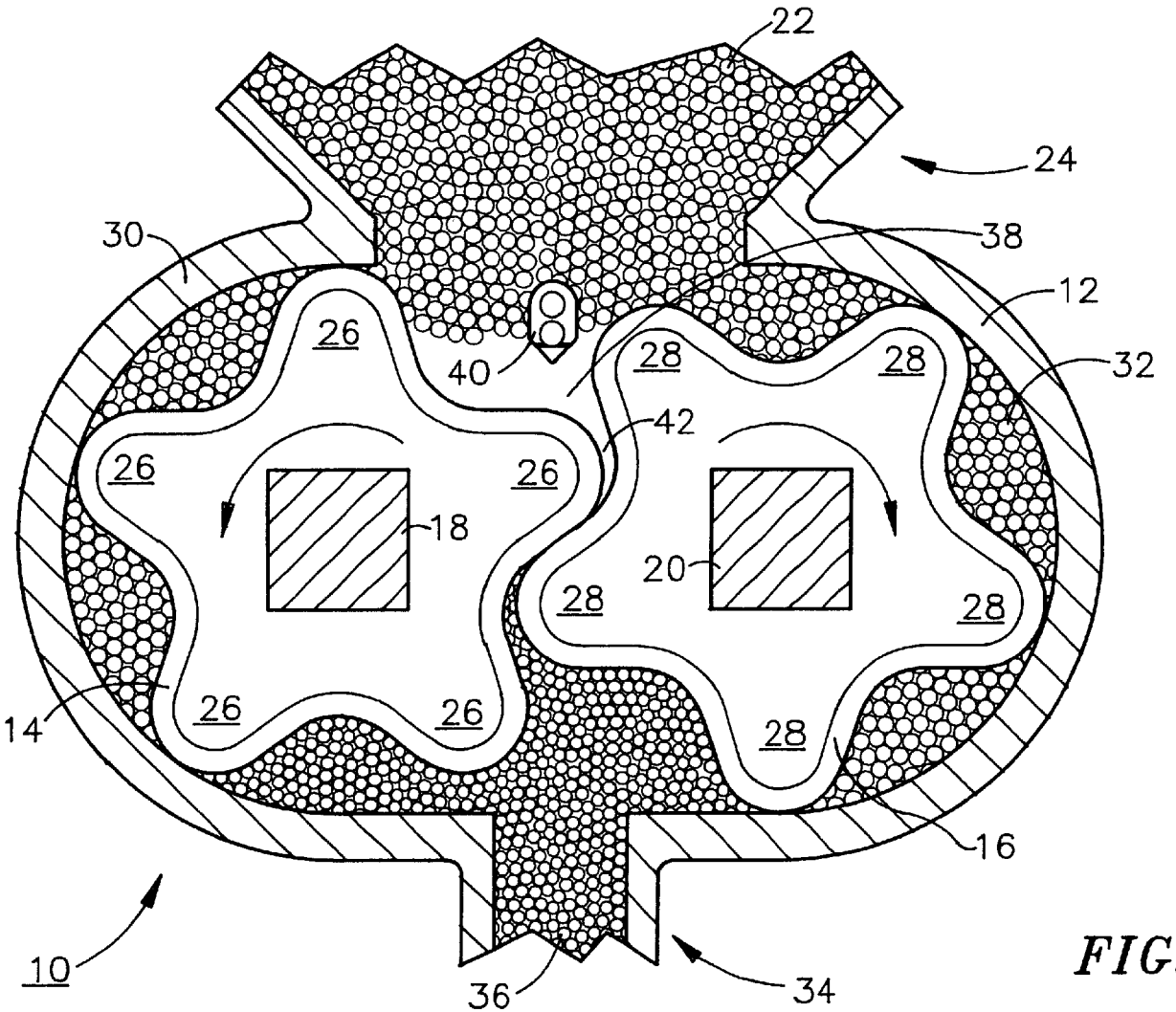
FIG. 2 is a cross-sectional view of a gear or lobe type pump incorporating the improvement of the present invention.

As shown in FIG. 2, the present invention solves this priming problem by the introduction of a vacuum tube 40 into the vicinity of nip point 42, i.e. that point where two lobes 26 and 28 approach each other and where gas pocket 38 occurs. Vacuum tube 40 provides the means to extract from nip point 42 gas entrapped in gas pocket 38 thereby eliminating this cause of back pressure against incoming material 22 and indeed drawing material 22 into nip point 42 by the negative force of the vacuum.

The particular level of vacuum utilized will, of course depend to some degree upon the consistency/viscosity of material 22 being pumped and is readily determinable by the skilled artisan having the instant disclosure before them. A vacuum of about 20 inches of mercury is considered appropriate for pumping materials such as pastry dough.

Figure 3:
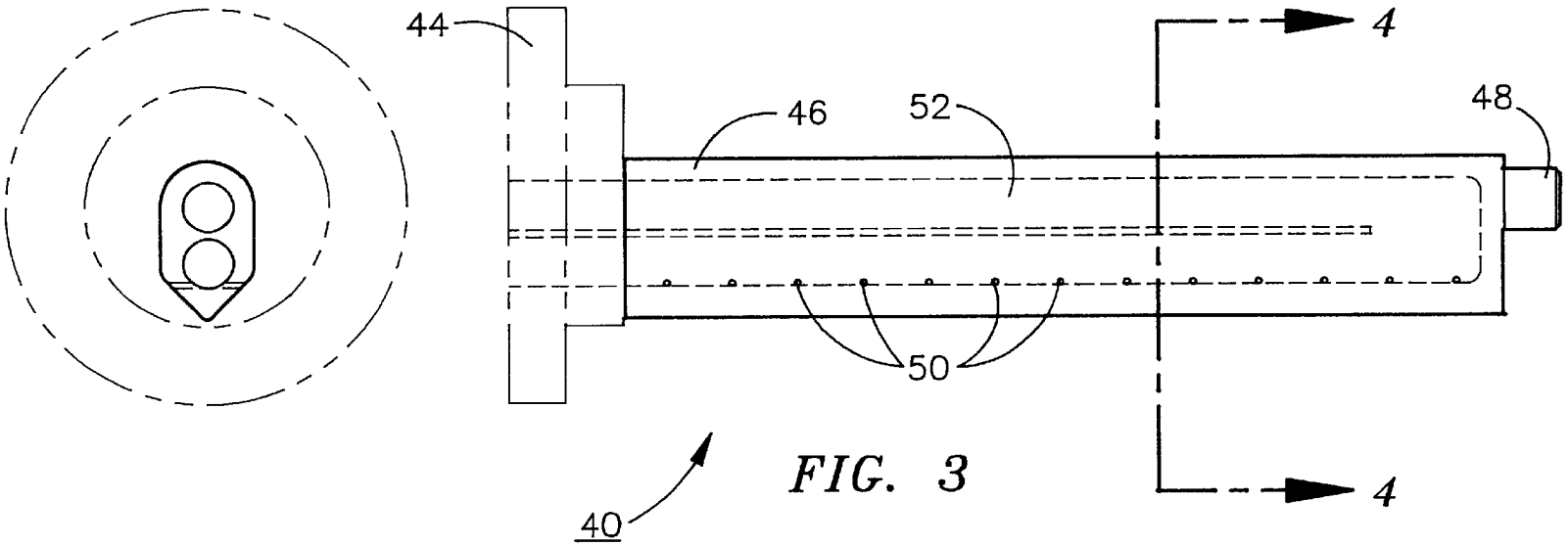
FIG. 3 is a phantom side view of one possible variant of the vacuum tube utilized in the pump and pumping method of the present invention of the present invention.
Figure 4:
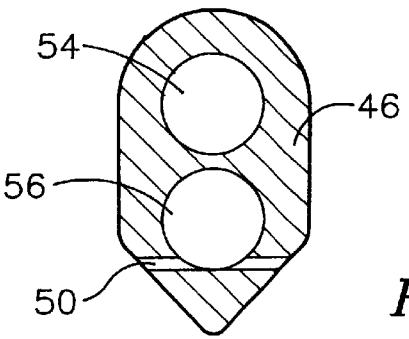
FIG. 4 is a cross-sectional view of the vacuum tube of FIG. 3 along the line 4—4 of FIG. 3.

The structure of vacuum tube 40 is not particularly critical so long as it is capable of extracting entrapped gas/air from the vicinity of nip point 42. One possible such useful structure for vacuum tube 40 is shown in FIGS. 3 and 4. As shown in FIG. 3, vacuum tube 40 comprises a mounting ring 44 for securing vacuum tube 40 at the appropriate location within housing 12 at nip point 42, a vacuum tube housing 46 and a rear support 48 for similarly mounting vacuum tube 40 in housing 12. Vacuum to the interior of vacuum tube 40 is supplied via apertures 50 whose structure and location are shown most clearly in FIG. 4. Gas/air and liquid (water) may be provided entering interior 52 of housing 46 through aperture 54 to assist with the removal by flushing of any material 22 entering apertures 50 and permitting their drawing to a tank trap 58 in vacuum line 60 as shown in FIG. 5.

Figure 5:
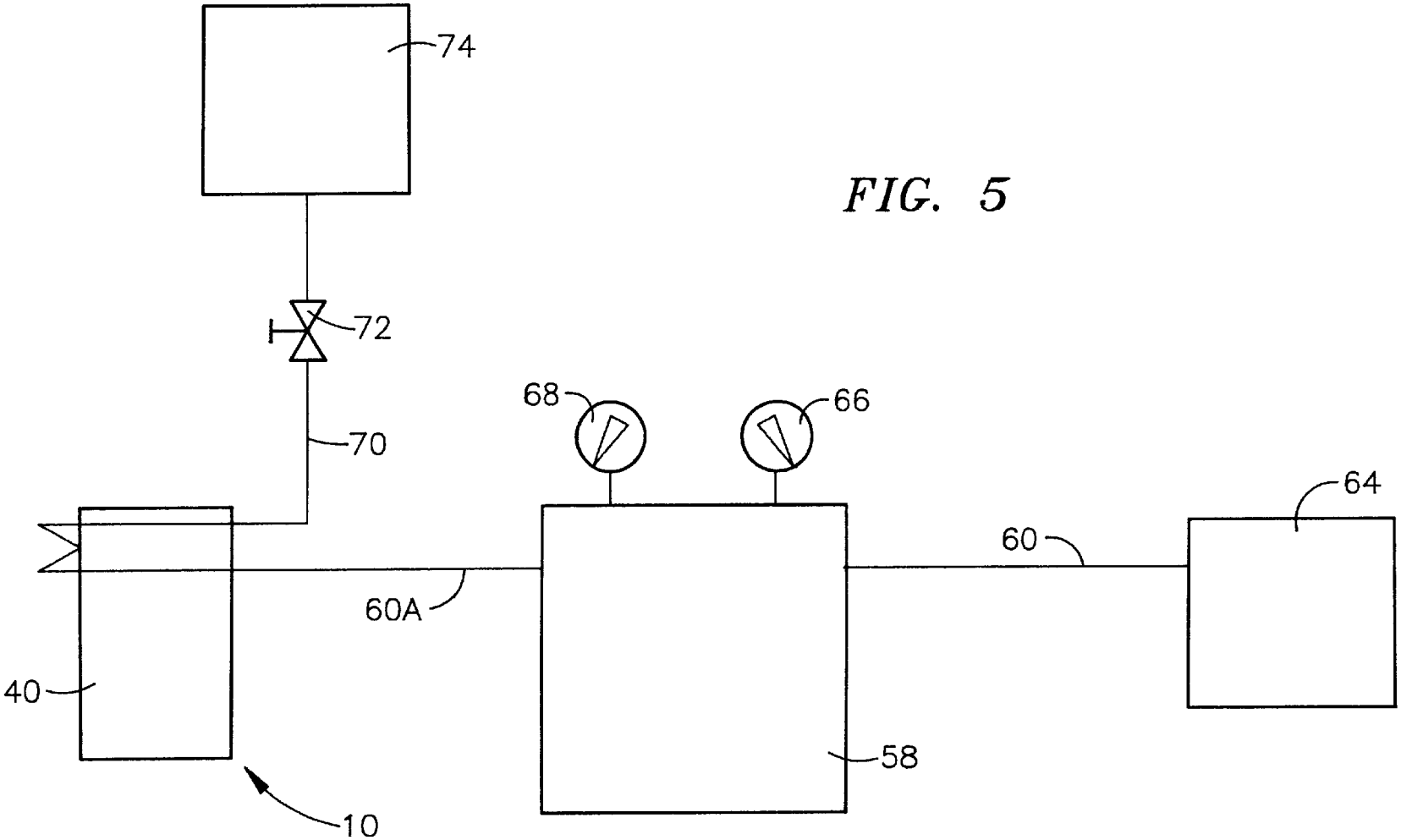
FIG. 5 is a schematic diagram of the complete vacuum system of the present invention.

FIG. 5 depicts a preferred overall vacuum system of the present invention. As shown in FIG. 5, the system operates by using a vacuum generator 64 that may be of a simple Venturi type. The generated vacuum is passed through vacuum line 60 and in turn through a vacuum tank trap 58 and thence via vacuum line 60A to apertures 50. Vacuum tank trap 58 is equipped with appropriate vacuum control and pressure detection gauges 66 and 68. In order to provide the flushing air or water that may be required to move material 22 entering apertures 50 and draining this material to vacuum tank trap 58 air/water/oil of appropriate composition and cleanliness can be bled into vacuum tube 40 via line 70 through a regulator 72 from supply tank 74. In this fashion, any material 22 that enters vacuum tube 40 and vacuum apertures 50 is drained to vacuum tank 58 via vacuum line 60A with the help of the inserted air/water/oil and vacuum tank 58 periodically cleaned.

From the foregoing description, one skilled in the art can easily ascertain the essential characteristics of this invention and without departing from the spirit and scope thereof make various changes and modifications to the invention to adapt it to various usages and conditions. It is therefor intended that the scope of the invention be limited only buy the scope of the appended claims.

What is claimed is:

1. In a positive displacement rotary pump for pumping viscous fluids comprising:

A) a housing having;

i) an inlet reservoir; and ii) a discharge port; and

B) a pair of counter rotating lobed gears within said housing, said counter rotating lobed gears defining a nip point where two lobes of said lobed gears meet;

the improvement comprising the inclusion of a vacuum tube in the vicinity of said nip point to provide a means for removal of any gas entrapped in said housing at said nip point.

2. A method for improving the viscous fluid priming characteristics of a positive displacement rotary pump comprising:

A) a housing having;

iii) an inlet reservoir; and iv) a discharge port; and

B) a pair of counter rotating lobed gears within said housing, said counter rotating lobed gears defining a nip point where two lobes of said lobed gears meet;

said method comprising the application of a vacuum via a vacuum tube located in the vicinity of said nip point to provide a means for removal of any gas entrapped in said housing at said nip point during pumping.

* * * * *